United States Patent [19]

Uchida et al.

[11] Patent Number: 4,924,836

[45] Date of Patent: May 15, 1990

[54] AIR/FUEL RATIO CONTROL SYSTEM FOR INTERNAL COMBUSTION ENGINE WITH CORRECTION COEFFICIENT LEARNING FEATURE

[75] Inventors: Masaaki Uchida; Hideki Uema; Hiromichi Miwa; Yoshihisa Kawamura, all of Kanagawa, Japan

[73] Assignee: Nissan Motor Company, Limited, Yokohama, Japan

[21] Appl. No.: 194,936

[22] Filed: May 17, 1988

[30] Foreign Application Priority Data

Jun. 26, 1987 [JP] Japan ..... 62-158989

[51] Int. Cl.[5] ..... F02D 41/14

[52] U.S. Cl. ..... 123/489

[58] Field of Search ..... 123/416, 417, 440, 480, 123/486, 489; 364/431.05

[56] References Cited

U.S. PATENT DOCUMENTS

| | | | |
|---|---|---|---|
| 4,359,029 | 11/1982 | Furuhashi et al. | 123/440 |
| 4,445,481 | 5/1984 | Aoki et al. | 123/489 X |
| 4,466,410 | 8/1984 | Sakakibara et al. | 123/489 X |
| 4,467,770 | 8/1984 | Arimura et al. | 123/489 |
| 4,589,390 | 5/1986 | Wazaki et al. | 123/339 |
| 4,674,459 | 6/1987 | Blocher et al. | 123/436 |
| 4,715,344 | 12/1987 | Tomisawa | 123/417 X |
| 4,729,359 | 3/1988 | Tomisawa et al. | 123/489 X |
| 4,796,589 | 1/1989 | Fujimoto et al. | 123/489 |
| 4,800,857 | 1/1989 | Tomisawa | 123/440 X |

FOREIGN PATENT DOCUMENTS

| | | |
|---|---|---|
| 0151768 | 8/1985 | European Pat. Off. . |
| 0213366 | 3/1987 | European Pat. Off. . |
| 61-101639 | 5/1986 | Japan . |
| 61-201842 | 9/1986 | Japan . |

*Primary Examiner*—Willis R. Wolfe

*Attorney, Agent, or Firm*—Foley & Lardner, Schwartz, Jeffery, Schwaab, Mack, Blumenthal & Evans

[57] ABSTRACT

An air/fuel ratio control system detects transition of air/fuel ratio changing between rich and lean for checking if updating condition is satisfied. Updating value is derived based on a feedback correction value which is derived for adjusting air/fuel ratio toward a stoichiometric value. With the updating value thus derived, one of a plurality of learnt correction value which are set with respect to various engine driving range.

39 Claims, 6 Drawing Sheets

AIR/FUEL RATIO CONTROL SYSTEM FOR INTERNAL COMBUSTION ENGINE WITH CORRECTION COEFFICIENT LEARNING FEATURE

BACKGROUND OF THE INVENTION

1. Field of the Invention

The present invention relates generally to an air/fuel ratio control system for an internal combustion engine, such as an automotive internal combustion engine, for adjusting a mixture ratio of an air/fuel mixture to be introduced into an engine combustion chamber for maintaining the air/fuel ratio as close as possible to a stoichiometric value. More specifically, the invention relates to an air/fuel ratio control system which can perform a learning process for continuously and cyclically updating the correction coefficient for a basic fuel delivery amount.

2. Description of Background Art

The Japanese Patent First (unexamined) Publication (Tokkai) Showa No. 60-145443 discloses an air/fuel ratio control system with a correction coefficient learning feature. The disclosed system is particularly directed for a so-called L-jectronics type fuel injection internal combustion engine and designed for performing air/fuel ratio control for the engine of this type. As is well known, air/fuel ratio control is performed by adjusting fuel delivery or fuel injection amount so that the air/fuel ratio can be held as close as possible to a stoichiometric value. It is also well known that a basic fuel injection amount Tp is determined generally on the basis of an engine speed indicative parameter and an engine load indicative parameter and is corrected by a plurality of correction factors, such as a cold engine enrichment factor, an acceleration enrichment factor and so forth. The air/fuel ratio is regarded as one of principle correction factor for correcting the basic fuel injection amount based thereon.

As is well known, the air/fuel ratio dependent correction factor is derived on the basis of an oxygen concentration in an exhaust gas. In the air/fuel ratio control system disclosed in the aforementioned Tokkai Showa No. 60-145443, the air/fuel ratio dependent correction factor is composed of a feedback component to be derived on the basis of the oxygen concentration in the exhaust gas and a learnt component which is set at a learnt value and continuously and cyclically updated through learning process. The learnt component of the air/fuel ratio dependent correction factor includes a plurality of values set with respect to respectively corresponding engine driving range which is defined by the engine speed indicative parameter and the engine load indicative parameter. Namely, in the practical air/fuel ratio control, one of the set correction values, which corresponds to the instantaneous engine driving range, is used.

Learning process for the learnt component for updating the set data is initiated when a predetermined condition suitable for updating the learnt component data. The condition regarded suitable for learning process will be hereafter referred to as "learning condition". During learning process, the learnt component data is updated with an updating value derived on the basis of the feedback component. Basically, and as is well known, CLOSED LOOP or FEEDBACK mode air/fuel ratio control is performed at stable engine driving condition. This means that the engine driving condition indicative parameters are held unchanged or changed within relatively narrow range. Therefore, the learning process may be performed while the engine driving condition is substantially stable for allowing FEEDBACK mode air/fuel ratio control. Furthermore, in order to maintain accuracy and precision of updated value with respect to each engine driving range, it is desirable to sample the updating data when the data per se is stable. Therefore, it is usual way to perform updating operation for updating the learnt component of the air/fuel ratio dependent correction factor when the data of the engine driving range is held at one range over a predetermined number of engine cycles. The condition to be regarded suitable for updating data of the learnt component will be hereafter referred to as "updating condition".

It should be noted the word "engine driving range" used throughout the disclosure and claims means an engine driving condition as defined by the engine speed parameter and the engine load indicative parameter. For this purpose, the engine speed is divided into a plurality of engine speed ranges and the engine load is divided into a plurality of engine load ranges. One engine driving range is defined by one engine speed range and one engine load range. As set forth above, the learnt component of the air/fuel ratio dependent correction factor is set in relation to each of the engine driving ranges and is updated when the feedback component as the updating data is derived at the corresponding engine driving range.

The engine driving range is to be of such a size as to be covered with a common learnt component value. In view of precision of air/fuel ratio control, the smaller size of the engine driving range is performed since the range to be covered by a common correction value set as the learnt component. On the other hand, the smaller size engine driving range will reduce frequency of updating of the data. Namely, as will be appreciated, the engine driving condition fluctuates frequently in relative narrow range. If the engine driving range is relatively wide, the fluctuation of the engine driving condition may occur within a same engine driving range to frequently satisfy the updating condition. On the other hand, when the set size of the engine driving range is substantially small, the engine driving range may frequently vary to reduce frequency of satisfying the updating condition.

SUMMARY OF THE INVENTION

Therefore, it is an object of the present invention to provide an air/fuel ratio control system which can avoid difficulties in the prior proposed learning air/fuel ratio control systems.

Another object of the invention is to provide an air/fuel ratio control system which can achieve satisfactorily high precision in correction of the fuel injection amount without causing difficulty in updating the correction data through learning process.

In order to accomplish the aforementioned and other objects, an air/fuel ratio control system, according to the present invention, detects transition of air/fuel ratio changing between rich and lean for checking if an updating condition is satisfied. Updating value is derived based on a feedback correction value which is derived for adjusting air/fuel ratio toward a stoichiometric value. With the updating value thus derived, one of a plurality of learnt correction value are set with respect to various engine driving range.

According to one aspect of the invention, an air/fuel ratio control system for an internal combustion engine comprises an induction system for supplying an air/fuel mixture to a combustion chamber in the engine, the induction system including a fuel injection system for injecting a controlled amount of fuel for forming a desired air/fuel mixture ratio, a first sensor monitoring a basic engine driving condition indicative parameter to produce a first sensor signal indicative thereof, a second sensor monitoring air/fuel ratio indicative parameter to produce a second sensor signal indicative thereof, the second sensor signal varying cyclically across zero according to a cyclic change of air/fuel mixture ratio between rich and lean across a stoichiometric value, third means for deriving a basic fuel injection amount on the basis of the first sensor signal value, fourth means for correcting the basic fuel injection value with a correction value, the correction value composed of a learnt component and a feedback component to be derived on the basis of the second sensor signal value for adjusting the air/fuel ratio toward the stoichiometric value, and fifth means, responsive to zero-crossing of the second sensor signal, for deriving an updating value to be substituted for the learnt component on the basis of the feedback component.

The fifth means derives the updating value with respect to one of a plurality of preset engine driving range at every occurrence of updating of the learnt component. The fifth means detects the engine driving condition on the basis of the first sensor signal and detect the engine driving condition satisfying a predetermined updating condition to update the learnt component with the updating value. Furthermore, the fifth means detects the engine driving condition satisfying a predetermined feedback control condition for feedback controlling air fuel ratio and detects the updating condition to update the learnt data with the updating data.

In the preferred construction, the first sensor monitors an engine speed indicative parameter to produce an engine speed indicative signal and an engine load condition indicative parameter to produce an engine load indicative signal and the third means derives the basic fuel injection amount on the basis of the engine speed indicative signal value and the engine load indicative signal value, the fifth means derives a first average value representative of an average value of the basic fuel injection amounts derived during an interval between zero-crossings of the second sensor signal and a second average value representative of an average value of the engine speed monitored during the interval, and the fifth means derives the engine driving range about which the learnt value is to be updated, on the basis of the first and second average values.

The fifth means further derives a maximum and a minimum basic fuel injection amount and a difference therebetween and disables updating of the learned value when the difference is greater than a given threshold value. Alternatively, the fifth means further derives a maximum and a minimum engine speed and a difference therebetween and disables updating of the learned value when the difference is greater than a given threshold value. In the further alternative, the fifth means compares the feedback component derived by the fourth means with an old feedback component derived at a timing of the occurrence of an immediately preceding zero-crossing of the second sensor signal to derive a difference therebetween and disables updating of the learned value when the difference is greater than a given threshold value.

Preferably, the fourth means derives the feedback component including a proportional component and an integral component. The fourth means modifies the proportional component in response to zero-crossing of the second sensor signal and modifies the integral component otherwise.

According to another aspect of the invention, an air/fuel ratio control system for an internal combustion engine comprises an induction system for supplying an air/fuel mixture to a combustion chamber in the engine, the induction system including a fuel injection system for injecting a controlled amount of fuel for forming a desired mixture ratio of air/fuel mixture, a first sensor monitoring a basic engine driving condition indicative parameter to produce a first sensor signal indicative thereof, a second sensor monitoring air/fuel ratio indicative parameter to produce a second sensor signal indicative thereof, the second sensor signal varying cyclically across zero according to cyclic change of air/fuel mixture ratio between rich and lean across a stoichiometric value, third means for deriving a basic fuel injection amount on the basis of the first sensor signal value, fourth means for correcting the basic fuel injection value with a correction value, the correction value composed of a learnt component and a feedback component to be derived on the basis of the second sensor signal value for adjusting the air/fuel ratio toward the stoichiometric value, and fifth means for detecting a transition of air/fuel ratio between rich and lean across a stoichiometric value on the basis of the second signal and detecting an engine driving condition satisfying a predetermined updating condition on the basis of the first sensor signal in order to derive an updating value to be substituted for the learnt component on the basis of the feedback component.

DESCRIPTION OF THE PREFERRED EMBODIMENT

Figure 1:
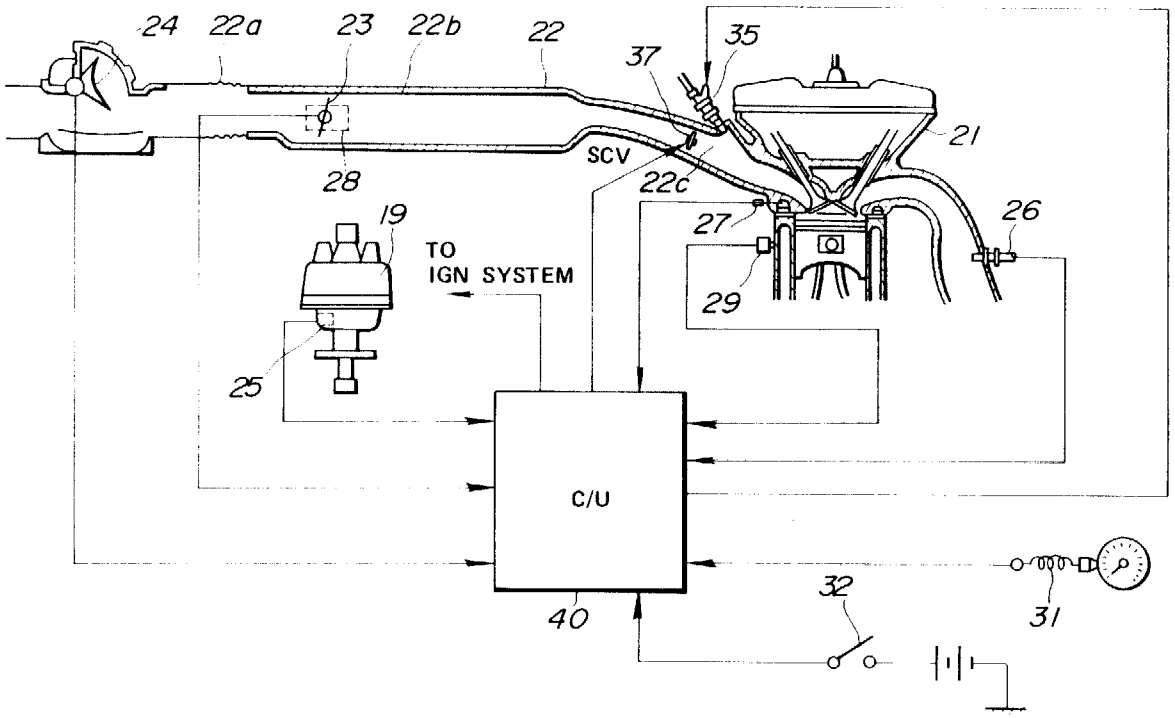
FIG. 1 is a schematic block diagram of the preferred embodiment of an air/fuel ratio control system for an internal combustion engine.
Figure 2:
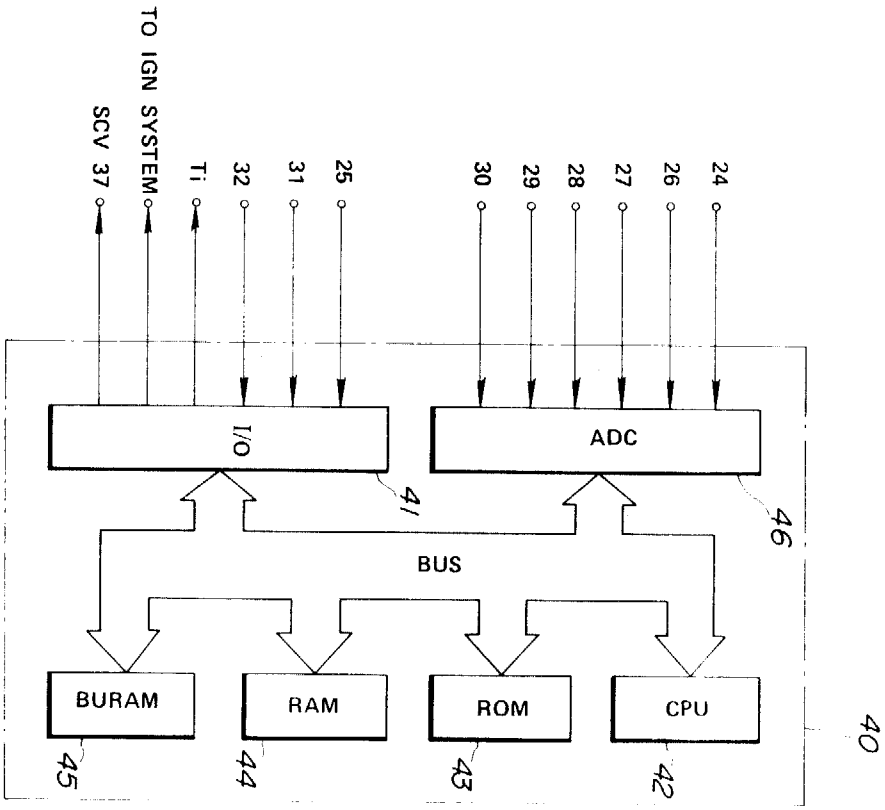
FIG. 2 is a block diagram showing a control unit employed in the preferred embodiment of the air/fuel ratio control system of FIG. 1.

Referring now to the drawings, particularly to FIG. 1, the preferred embodiment of an air/fuel ratio control system will be illustrated herebelow in terms of the application thereof to a L-jectronics type fuel injection internal combustion engine. It will be naturally appreciated that though the discussion hereinbelow given will concentrate in learning air/fuel ratio control for the specific type of engine for facilitating better understanding of the invention, it is not intended to limit the invention to the shown application.

As shown in FIG. 1, the L-jectronics type fuel injection internal combustion engine includes an engine block 21 defining therein one or more combustion chambers. The engine combustion chamber is communicated with an induction system 22 through which an air/fuel mixture is applied via an intake port opened and closed by means of an intake valve. The engine combustion chamber is also communicated with an exhaust system in order to discharge an exhaust gas therethrough.

The induction system 22 of the engine is per se well known construction and includes an air inlet (not shown), an air cleaner (not shown), an intake air duct 22*a*, a throttle valve assembly 22*b*, in which is pivotably disposed a throttle valve 23, and an intake manifold 22*c* having a plurality of branch passages communicated with respective engine combustion chamber. A flap type air flow meter 24 is provided in the induction system 22 upstream of the throttle body. The flap type air flow meter 24 is of per se well known construction and monitors an intake air flow rate Q which is representative of an engine load to produce an intake air flow rate indicative signal. One or more fuel injection valve 35 is provided in the intake manifold 22*c* to inject a controlled amount of fuel into the intake manifold for forming an air/fuel mixture to be introduced into the engine combustion chamber. In order to obtain uniform mixture ratio of the air/fuel mixture and to obtain better fuel atomization characteristics, the shown embodiment of the induction system 22 incorporates a swirl control valve 37. The swirl control valve 37 is disposed in the induction system upstream of the fuel injection valve 35 and operated to open and close to generate a strong swirl around the fuel injection valve 35 while the engine is driven at low load condition. The swirl of the intake air will encourage atomization of the fuel and mixing of the air and fuel to unify the mixture ratio of the air/fuel mixture.

A throttle angle sensor 28 is associated with the throttle valve 23 to monitor the angular position of the latter to produce a throttle angle signal $\theta_{th}$.

The engine is also associated with an ignition system for performing spark ignition in each engine combustion chamber at a controlled timing in synchronism with the engine revolution cycle. The ignition system may include an ignition coil (not shown) for generating an high voltage ignition power, a power transistor and a distributor 19 for distributing ignition power to each ignition plug (not shown) at a controlled timing in synchronism with engine revolution cycle. A crank angle sensor 25 is incorporated in the distributor 19. The crank angle sensor 25 is of per se well known construction to have a rotary disk and an optical or electromagnetic sensor cooperative with the rotary disk for monitoring angular position of the rotary disk. As is well known, the distributor 19 has a rotor rotatingly driven with a rotor shaft in synchronism with the engine revolution so as to distribute the ignition power to the ignition plug in the engine combustion chamber near top-dead-center (TDC) in compression stroke. Namely, the rotor of the distributor 19 is so driven as to complete one rotation cycle during two engine revolution cycles, in which a crank shaft rotate two cycles. The rotary disk of the crank angle sensor 25 is fixed to the rotor shaft of the distributor for rotation therewith to complete one rotation cycle through two cycles of engine revolution. The crank angle sensor 25 is designed to produce a crank reference signal $\theta_{ref}$ at every predetermined angular position corresponding to 70° or 110° before TDC (BTDC) of each engine cylinder. The crank angle sensor 25 also produces a crank position signal $\theta_{pos}$ at every given angle, e.g. 2° of crank shaft angular displacement.

An oxygen sensor (hereafter $O_2$ sensor) is disposed in the exhaust system for monitoring an oxygen concentration contained in the exhaust gas to produce an oxygen concentration indicative signal which will be hereafter referred to as "$O_2$ sensor signal LAMBDA". The $O_2$ sensor signal LAMBDA is representative of deviation of mixture ratio of air/fuel mixture in relation to a known stoichiometric value and thus representative of rich and lean of the mixture. An engine coolant temperature sensor 27 is disposed within an engine cooling chamber for monitoring temperature of engine coolant to produce an engine coolant temperature indicative signal Tw.

A control unit 40 is provided for controlling fuel injection timing, fuel injection amount, spark ignition timing and position of the swirl valve. In order to perform control operation, the control unit 40 is connected to the air flow meter 24 to receive the air flow rate indicative signal Q, a throttle angle sensor 28 to receive therefrom the throttle angle indicative signal $\theta_{th}$, the engine coolant temperature sensor to receive therefrom the engine coolant indicative signal Tw, and the $O_2$ sensor to receive the $O_2$ sensor signal LAMBDA. In addition, the control unit 40 is connected to a vehicular battery 30 via an ignition switch 32 to receive power supply therefrom. From the supplied power from the vehicular battery 30, the control unit 40 detects the battery voltage Bv as one of fuel injection amount correction parameter. The control unit 40 is further connected to a knock sensor 29 which monitors engine knocking condition to produce an engine knocking magnitude indicative signal KNOCK, and a vehicle speed sensor 31 to receive therefrom a vehicle speed indicative signal V.

The control unit 40 includes an input/output interface 41, CPU 42, ROM 43, RAM 44 and a non-volatile RAM (BURAM) 45. In addition, the control unit 40 includes an analog-to-digital (A/D) converter 46 for converting the analog inputs, i.e. the air flow rate indicative signal Q, the $O_2$ sensor signal LAMBDA, the engine coolant temperature indicative signal Tw, the throttle angle indicative signal $\theta_{th}$, the engine knocking magnitude indicative signal KNOCK and the batteryvoltage data Bv, into digital signal appliable to the microprocessor.

ROM 43 stores a various control programs, such as a fuel injection timing control program, a fuel injection amount control program, an spark ignition timing control program, a swirl control valve control program and so forth. ROM 43 also stores a main control program governing execution of the aforementioned plurality of programs in time-sharing base. Though the control unit 40 performs various control operations according to the programs set in ROM 43, the following discussion may be concentrated to air/fuel ratio control by controlling the fuel injection amount on the basis of the oxygen concentration in the exhaust gas.

In general, air/fuel ratio control is performed for correcting a basic fuel injection amount Tp derived on the basis of an engine speed dependent parameter N and an engine load dependent parameter Q and obtained from:

$$Tp = K \times Q/N$$

where K is a known constant value. A correction value for the basic fuel injection amount Tp is determined as a correction coefficient based on the $O_2$ sensor signal value LAMBDA. As is well known, the air/fuel ratio control is performed in FEEDBACK or CLOSED LOOP mode while the engine driving condition is stable enough to perform FEEDBACK or CLOSED LOOP mode control and, otherwise in OPEN LOOP mode. The correction coefficient for air/fuel ratio control will hereafter referred to as "LAMBDA correction coefficient $K_{LAMBDA}$". The LAMBDA correction coefficient $K_{LAMBDA}$ is composed of a feedback component $K_{FEEDBACK}$ variable depending upon the $O_2$ sensor signal value LAMBDA, and a learnt component $K_{LEARN}$ which is to be updated continuously whenever a predetermined updating condition is satisfied. The feedback component $K_{FEEDBACK}$ includes a proportional (P) component and an integral (I) component. On the other hand, the learnt component $K_{LEARN}$ is set with respect to each engine driving range of a predetermined size as defined by engine speed range and engine load range as set forth above.

The learnt component $K_{LEARN}$ derived with respect to each corresponding engine driving range is stored in a memory block in BURAM 45. The memory block of the BURAM 45 is divided into a plurality of memory areas, each of which is identified by a known address. Each of the memory areas is given the address corresponding to the engine driving range, is designed to store the learnt component $K_{LEARN}$ determined with respect to the corresponding engine driving range.

It should be noted that the learnt component $K_{LEARN}$ is required for optimizing air/fuel ratio control for compensating deviation in air/fuel ratio control caused due to variation of intake air density. Namely, the intake air density is variable depending upon the atmospheric air density for obtaining precise air/fuel ratio control.

The following discussion concerns the process of air/fuel ratio control to be performed by the preferred embodiment of the air/fuel ratio control system according to the invention. The discussion of the practical operation of air/fuel ratio control will be discussed herebelow with reference to FIGS. 3 to 7.

Figure 3:
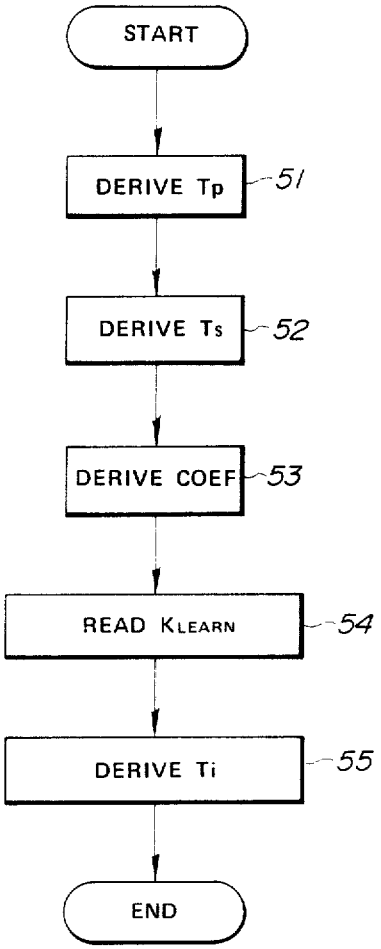
FIG. 3 is a flowchart showing a routine for deriving a fuel injection pulse width, which routine is programmed in the control unit to be executed therein.

FIG. 3 shows a flowchart of a fuel injection amount control routine, in which a fuel injection amount is determined. The routine shown in FIG. 3 is triggered every predetermined timing, e.g. every 10 ms or 20 ms for deriving the fuel injection amount or fuel injection pulse width Ti.

Figure 4:
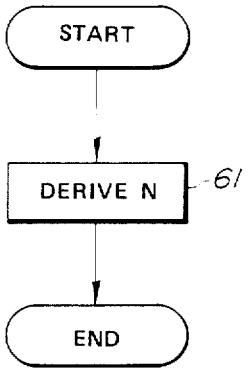
FIG. 4 is a flowchart showing a routine programmed in the control unit for deriving an engine revolution speed data N.

Immediately after starting execution, an engine speed data N is read as the engine speed dependent parameter and the intake air flow rate indicative signal value Q as the engine load dependent data are read at a step 51. In practice, the engine speed data N is derived on the basis of a frequency of the crank position signal $\theta_{pos}$. In order to derive the engine speed data N, a routine shown in FIG. 4 is triggered at a predetermined timing. In the process of FIG. 4, the crank position signals $\theta_{pos}$ is counted within a predetermined period at a step 61. For this purpose, an engine speed counter (not shown) may be provided in the input/output unit 41. The engine speed counter may be triggered at the initial stage of the step 61. At the same time, an engine speed timer (not shown) is also triggered to measure the predetermined period. When the timer value of the engine speed timer reaches a given value corresponding to the predetermined period, the counter value of the engine counter is latched. At the step 61, the latched counter value is processed to derive the engine speed data N. The process for deriving the engine speed data N based on the count of the crank position signal $\theta_{pos}$ is a well known technique and requires no detailed discussion.

Though the shown embodiment takes the crank position signal $\theta_{pos}$ as engine speed indicative parameter, it is also possible to derive the engine speed by measuring an interval of occurrences of the crank reference signals $\theta_{ref}$. Namely, the period of the pulse form crank reference signal $\theta_{ref}$ is inversely proportional to the engine speed, the engine speed data can be obtained by obtaining receprocal of the pulse period of the crank reference signal $\theta_{ref}$. This procedure in derivation of the engine speed data N may be preferred when the economical system rather than high precision is required.

Returning to FIG. 3, at the step 51, the basic fuel injection amount or basic fuel injection pulse width Tp is derived on the basis of the read engine speed data N and the intake air flow rate Q according to the foregoing equation.

At a step 52, a battery voltage dependent correction value Ts is derived on the basis of the battery voltage data Bv. Subsequently, a fuel injection amount correction coefficient COEF is calculated based on a plurality of engine driving condition dependent correction factors (coefficients). At a step 53, the fuel injection amount correction coefficient COEF may be derived by:

$$COEF = K_{Tw} + K_{ACC} + K_{START}$$

wherein

- $K_{Tw}$ is an engine coolant temperature dependent correction coefficient derived on the basis of the engine coolant temperature indicative signal value Tw;
- $K_{ACC}$ is an acceleration enrichment correction value to be set in response to acceleration demand which is detected by monitoring the throttle angle indicative signal value $\theta_{th}$;
- $K_{START}$ is an engine start-up enrichment correction coefficient which is set during engine cranking.

It should be appreciated that, though the fuel injection amount correction coefficient COEF is determined with three engine driving condition dependent correction coefficients set forth above, it may possible to introduce additional engine driving condition dependent and/or environmental condition dependent correction coefficients as required. Therefore, the correction coefficient COEF herein disclosed should not be regarded as essential to the shown embodiment.

At a step 54, the learnt component $K_{LEARN}$ is read from BURAM 45. In order to enable reading of the learnt component $K_{LEARN}$, the instantaneous engine driving range is determined on the basis of the engine speed data N and the intake air flow rate indicative data Q. Based on the engine driving range, the learnt component $K_{LEARN}$ corresponding to the engine driving range, is read. At a step 55, the basic fuel injection amount Tp is corrected by the correction values Ts, COEF and $K_{LEARN}$ to derive the fuel injection amount Ti. The correction of the basic fuel injection amount Tp is performed by the following equation:

$$Ti = Tp \times COEF \times K_{FEEDBACK} \times K_{LEARN} + Ts$$

The fuel injection amount Ti is set in a known register in the input/output unit 41. The construction of the input/output unit for driving the fuel injection valve 35 at a controlled timing and holding the fuel injection value open for a period corresponding to the fuel injection pulse width which corresponding to the fuel injection amount Ti derived as set forth above.

Figure 5:
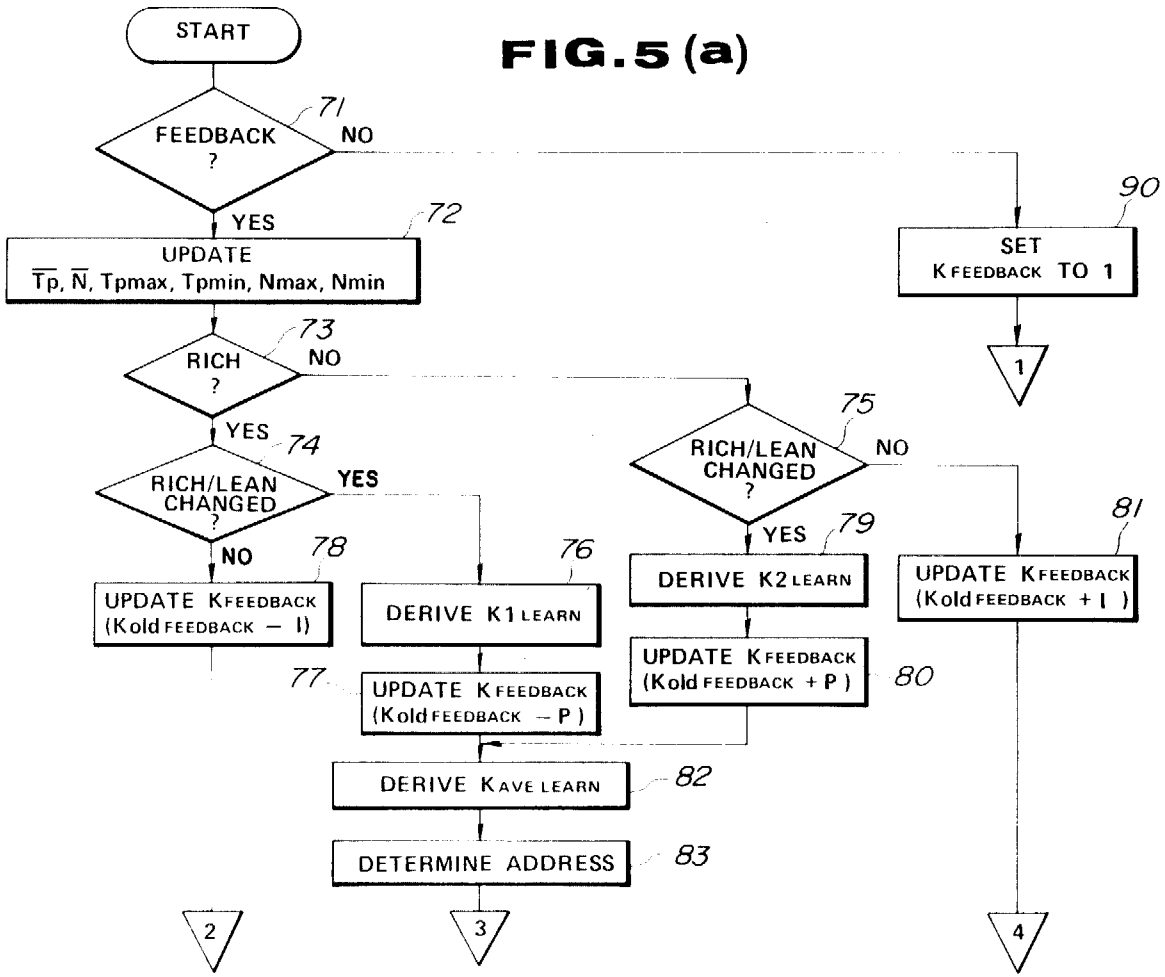
FIGS. 5(*a*) and 5(*b*) are flowchart showing a sequence of routine programmed in the control unit for deriving an air/fuel ratio dependent correction value, which routine including learning of the air/fuel ratio dependent correction value.
Figure 5:
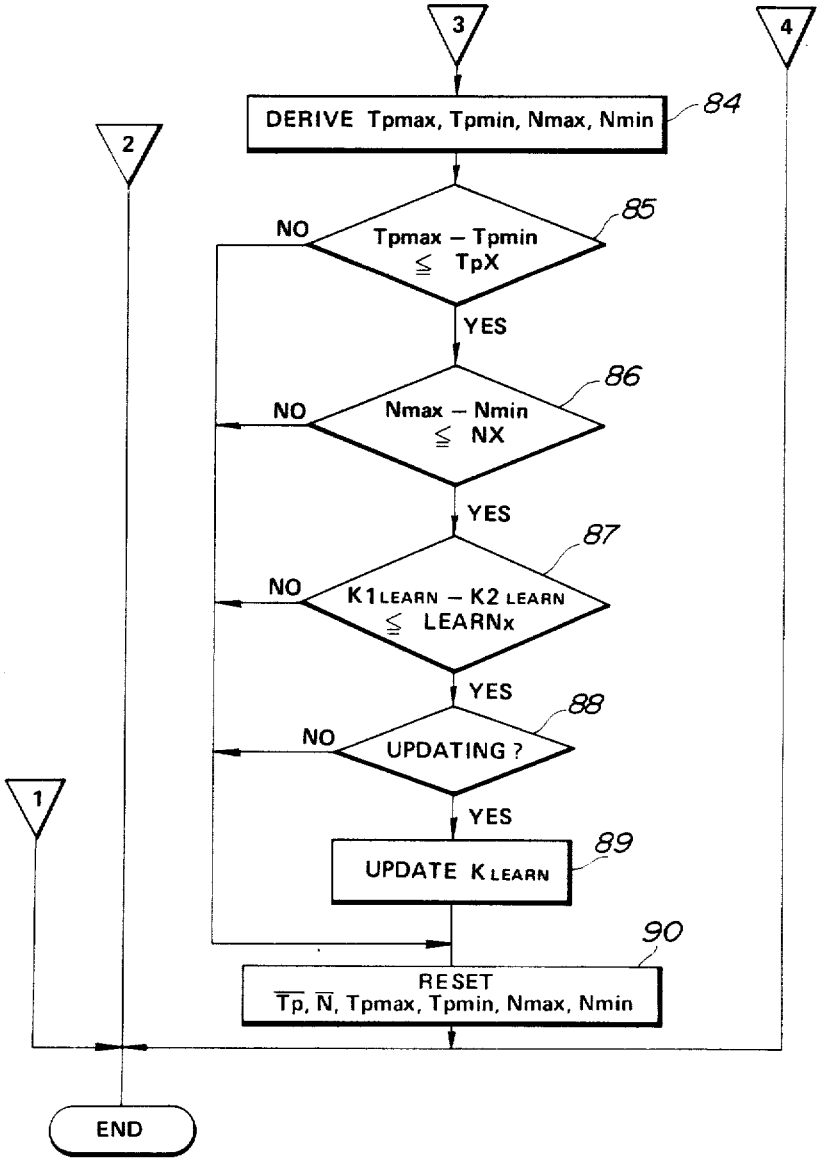

FIGS. 5(*a*) and 5(*b*) shows a routine for deriving the feedback component $K_{FEEDBACK}$ and the learnt component $K_{LEARN}$ and updating the learnt component. The shown routine is triggered with a given interval.

Immediately after starting execution, the engine driving condition is checked whether a predetermined feedback condition is satisfied at a step 71. As set forth above, FEEDBACK mode air/fuel ratio control can be performed when the engine driving condition is stable. The feedback condition may be set with various criteria such as engine speed variation, engine load variation, throttle angle variation rate and so forth. For example, FEEDBACK/OPEN LOOP criteria to selectively perform FEEDBACK mode and OPEN LOOP mode air/fuel ratio control is disclosed in the U.S. Pat. No. 4,359,029, issued on Nov. 16, 1982, which is assigned to the common assignee to the present invention.

When the engine driving condition as checked at the step 71 does not satisfy the predetermined feedback condition, OPEN LOOP mode air fuel ratio control is selected. In the OPEN LOOP mode control, the feedback component $K_{FEEDBACK}$ of the air/fuel ratio dependent correction coefficient $K_{LAMBDA}$ is set at a value one (1), at a step 90. In this case, the process goes to END after setting the feedback component $K_{FEEDBACK}$ at the value 1.

Figure 6:
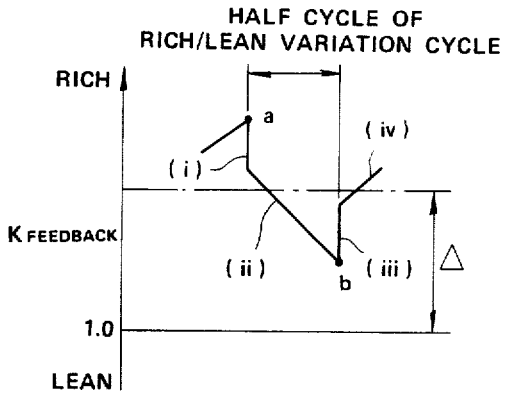
FIG. 6 is a chart showing variation of a feedback component of the air/fuel ratio dependent correction value.
Figure 7:
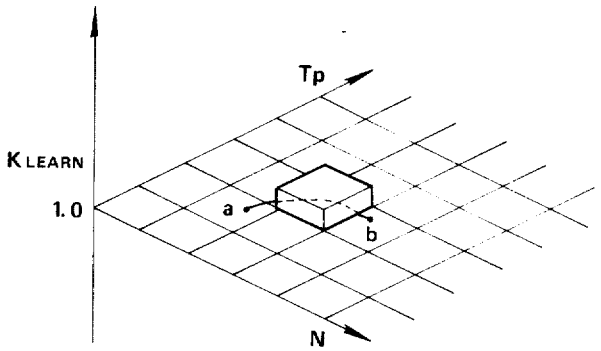
FIG. 7 is an explanatory illustration showing learnt component of the air/fuel ratio dependent correction values.

On the other hand, when the engine driving condition satisfying the feedback condition is detected as checked at the step 71, average values $Tp_{ave}$ of the basic fuel injection amount Tp and $N_{ave}$ of the engine speed data N over a half cycle of the $O_2$ sensor signal variation cycle, through which the air/fuel ratio varies between rich and lean across the stoichiometric value, as shown in FIG. 6, are updated, at a step 72. Also, at the step 72, the variation range of the basic fuel injection amount as defined by the maximum and minimum basic fuel injection amounts $Tp_{max}$ and $Tp_{min}$ and the variation range of the engine speed as defined by the maximum and minimum engine speed $N_{max}$ and $N_{min}$ derived over the half cycle of rich/lean invertion cycle of the air fuel mixture, are updated.

It should be noted the average values $Tp_{ave}$ of the basic fuel injection amount and the average value $N_{ave}$ as derived at the step 72 is used as a data identifying the address cf the memory area of the memory block storing the learnt component $K_{LEARN}$ for learning operation for updating the data of the learnt component $K_{LEARN}$. On the other hand, the variation range of the basic fuel injection amount as defined by the maximum and minimum basic fuel injection amounts $Tp_{max}$ and $Tp_{min}$ and the variation range of the engine speed as defined by the maximum and minimum engine speed $N_{max}$ and $N_{min}$ are used for discriminating the engine driving condition whether the learning condition and updating condition is satisfied or not, in the following process.

At a step 73, the $O_2$ sensor signal value LAMBDA is checked whether it indicates rich or lean. When the $O_2$ sensor signal LAMBDA as checked at the step 73 indicates rich mixture condition, whether the air/fuel ratio as represented by the $O_2$ sensor signal LAMBDA checked during the immediately preceding execution cycle was rich, at a step 74. Similarly, when the $O_2$ sensor signal LAMBDA as checked at the step 73 indicates lean mixture condition, whether the air/fuel ratio as represented by the $O_2$ sensor signal LAMBDA checked during the immediately preceding execution cycle was rich, at a step 75.

The steps 73, 74 and 75 are provided for PI controlling the feedback component $K_{FEEDBACK}$ of the air/fuel ratio dependent correction coefficient $K_{LAMBDA}$. Namely, in the shown embodiment, (i) the P component is modified by reducing a given value corresponding to a P constant when the mixture ratio is inverted from lean to rich as detected through the steps 73 and 74, (ii) the I component is modified by reducing a given value corresponding I constant when the mixture is held rich after once inverted from lean to rich, (iii) the P component is modified by addition the given value (P constant) when the mixture ratio is inverted from rich to lean as detected through the steps 73 and 75, and (iv) the I component is modified by adding the given value (I constant) while the maxture ratio is held lean after once inverted from rich.

Therefore, in the practical operation, change of the mixture ratio between rich and lean can be detected by detecting inversion of polarity of the $O_2$ sensor signal value LAMBDA. Namely, while the air/fuel mixture is held rich, the $O_2$ sensor signal value LAMBDA is held positive and, on the other hand, while the air/fuel mixture is held lean, the $O_2$ sensor signal is held negative. Therefore, at the steps, the polarity of the $O_2$ sensor signals read in the current execution cycle and immediately preceding cycle are checked at the steps 73, 74 and 75.

When the $O_2$ sensor signal LAMBDA changes polarity from negative value representing lean mixture to positive value representing rich mixture through the steps 73 and 74, the feedback component data $Kold_{FEEDBACK}$ derived at the immediately preceding execution cycle is read and set as a basic feedback component $K1_{LEARN}$ in a temporary register (not shown) in the control unit 40, at a step 76. The basic feedback component $K1_{LEARN}$ thus set is modified by subtracting the P constant in order to determine the feedback component $K_{FEEDBACK}$, at a step 77. With this feedback component $K_{FEEDBACK}$ derived at the step 77, the feedback component data stored in another memory block of the temporary register is updated, at the step 77.

If the polarity of the $O_2$ sensor signal LAMBDA is not changed as checked through the steps 73 and 74 and thus held positive, the feedback component $K_{FEEDBACK}$ is derived by modifying the feedback component $Kold_{FEEDBACK}$ derived in the immediately preceding cycle by subtracting the I constant, at a step 78.

On the other hand, when the $O_2$ sensor signal LAMBDA changing polarity from positive value representing rich mixture to negative value representing lean mixture through the steps 73 and 75, the feedback component data $Kold_{FEEDBACK}$ derived at the immediately preceding execution cycle is read and set as a basic feedback component $K2_{LEARN}$ in a further different memory block in the temporary register in the control unit 40, at a step 79. The basic feedback component $K2_{LEARN}$ thus set is modified by adding the P constant in order to determine the feedback component $K_{FEEDBACK}$, at a step 80. With this feedback component $K_{FEEDBACK}$ derived at the step 80, the feedback component data stored in another memory block of the temporary register is updated, at the step 80.

If the polarity of the $O_2$ sensor signal LAMBDA is not changed as checked through the steps 73 and 75 and thus held negative, the feedback component $K_{FEEDBACK}$ is derived by modifying the feedback component $Kold_{FEEDBACK}$ derived in the immediately preceding cycle by adding the I constant, at a step 81.

After the step 78 or 81, process goes END to return the main routine. On the other hand, after the process of the step 77 or 80, an average value $Kave_{LEARN}$ of the basic feedback components $K1_{LEARN}$ and $K2_{LEARN}$ is calculated at a step 82. At a step 83, the average basic fuel injection amount $Tp_{ave}$ and the average engine speed $N_{ave}$ through the half cycle of mixture ratio variation are derived. Based on the derived average basic fuel injection amount $Tp_{ave}$ and the average engine speed $N_{ave}$, the engine driving range is identified, at the step 83. By identifying the engine driving range, the address of the memory area in the memory block of BURAM 45 to be updated can be identified. Then, the maximum and minimum basic fuel injection amounts $Tp_{max}$ and $Tp_{min}$ and the maximum and minimum engine speed $N_{max}$ and $N_{min}$ are derived over the half cycle of the mixture ratio variation, at a step 84.

At a step 85, a difference of the maximum and minimum basic fuel injection amounts $Tp_{max}$ and $Tp_{min}$ is determined and compared with a predetermined fuel injection amount threshold Tpx which represents allowable maximum difference between the maximum and minimum basic fuel injection amounts $Tp_{max}$ and $Tp_{min}$. When the difference $(Tp_{max}-Tp_{min})$ is greater than the fuel injection amount threshold Tpx, which means that the basic fuel injection amount in the half cycle of mixture ratio variation is greater than a predetermined range and thus means that the engine driving condition is not suitable for learning. Therefore, the process goes to a step 90 without updating the learnt component $K_{LEARN}$. On the other hand, when the difference $(Tp_{max}-Tp_{min})$ is smaller than or equal to the fuel injection amount threshold, as checked at the step 85, a difference between the maximum engine speed $N_{max}$ and the minimum engine speed $N_{min}$ is determined at a step 86. The difference $(N_{max}-N_{min})$ is compared with an engine speed threshold Nx which represents allowable maximum difference between the maximum engine speed $N_{max}$ and the minimum engine speed $N_{min}$, at the step 86. Similarly to the foregoing, when the difference $(N_{max}-N_{min})$ is greater than the engine speed threshold Nx, it means that the engine speed fluctuates within the half cycle of the mixture ratio variation and thus means that the engine driving condition is not suitable for learning. Therefore, the process goes to the step 90. On the other hand, when the difference $(N_{max}-N_{min})$ as checked at the step 86 is smaller than or equal to the engine speed threshold Nx, a difference of the basic feedback components $K1_{LEARN}$ and $K2_{LEARN}$ is calculated at a step 87. When the difference $(K1_{LEARN}-K2_{LEARN})$ is compared with a correction value threshold LEARNx which represents allowable maximum difference between the feedback components $K1_{LEARN}$ and $K2_{LEARN}$ is greater than correction value threshold LEARNx, process goes to step 90. On the other hand, when the difference $(K1_{LEARN}-K2_{LEARN})$ is smaller than or equal to the correction value threshold LEARNx, check is performed whether the updating condition is satisfied or not at a step 88. As set forth, the updating condition in the shown embodiment is satisfied when the operation mode of the air/fuel ratio control system is FEEDBACK mode and when the engine coolant temperature Tw is higher than or equal to a predetermined temperature $Tw_{LRC}$. When the updating condition is not satisfied as checked at the step 88, process goes to step 90. On the other hand, when the updating condition is satisfied as checked at the step 88, an updating data $Knew_{LEARN}$ is calculated at a step 89 with the following equation:

$$Knew_{LEARN}=Kold_{LEARN}+R(Kave_{LEARN}-1)$$

where $Kold_{LEARN}$ is a learnt component data already stored in the memory area identified by the address which is identified by the average basic fuel injection amount $Tp_{ave}$ and the average engine speed $N_{ave}$, and R is an updating constant set for updating the learnt component data with preventing hunting in control, which updating constant is therefore set at a value smaller than one.

Updating data $Knew_{LEARN}$ is then written in the memory area identified by the address and then $\overline{Tp}$, $\overline{N}$, Tpmax, Tpmin, Nmax, Nmin are reset at the step 90.

Therefore, as will be appreciated, the present invention can increase frequency of updating of the learning data for air/fuel ratio control at higher frequency and with maintaining satisfactorily high precision in control by maintaining the size of each engine driving range small enough.

Therefore, the invention fulfills all of the objects and advantages sought therefor.

What is claimed is:

1. An air/fuel ratio control system for an internal combustion engine comprising:

an induction system for supplying an air/fuel mixture to a combustion chamber in the engine, said induction system including a fuel injection system for injecting a controlled amount of fuel for forming a desired air/fuel mixture ratio;

a first sensor monitoring a basic engine driving condition indicative parameter to produce a first sensor signal indicative thereof;

a second sensor monitoring an air/fuel ratio indicative parameter to produce a second sensor signal indicative thereof, said second sensor signal varying cyclically across zero according to a cyclic change of the air/fuel mixture ratio between rich and lean across a stoichiometric value;

third means for deriving a basic fuel injection amount on the basis of said first sensor signal value;

fourth means for correcting said basic fuel injection amount with a correction value, said correction value comprising a learnt component and a feedback component to be derived on the basis of said second sensor signal value for adjusting the air/fuel ratio toward said stoichiometric value; and fifth means, responsive to said zero-crossing of said second sensor signal, for deriving an updating value to be substituted for said learnt component on the basis of said feedback component, said fifth means deriving said updating value with respect to one of a plurality of preset engine driving ranges at every occurrence of updating of said learnt component.

2. An air/fuel ratio control system as set forth in claim 1, wherein said fifth means detects the engine driving condition on the basis of said first sensor signal and detect the engine driving condition satisfying a predetermined updating condition to update said learnt component with said updating value.

3. An air/fuel ratio control system as set forth in claim 2, wherein said fifth means detects the engine driving condition satisfying a predetermined feedback control condition for performing feedback control of air/fuel ratio and detects the updating condition in which enrichment demand is absent to update said learnt data with said updating data.

4. An air/fuel ratio control system as set forth in claim 3, wherein said first sensor monitors an engine speed indicative parameter to produce an engine speed indicative signal and an engine load condition indicative parameter to produce an engine load indicative signal and said third means derives said basic fuel injection amount on the basis of said engine speed indicative signal value and said engine load indicative signal value, said fifth means derives a first average value representative of an average value of said basic fuel injection amounts derived during an interval between zero-crossing of said second sensor signal and a second average value representative of an average value of the engine speed monitored during said interval, and said fifth means derives the engine driving range about which said learnt value is to be updated, on the basis of said first and second average values.

5. An air/fuel ratio control system as set forth in claim 4, wherein said fifth means further derives a maximum and minimum basic fuel injection amount and a difference therebetween and disables updating of said learned value when said difference is greater than a given threshold value.

6. An air/fuel ratio control system as set forth in claim 4, wherein said fifth means further derives a maximum and minimum engine speed and a difference therebetween and disables updating of said learned value when said difference is greater than a given threshold value.

7. An air/fuel ratio control system as set forth in claim 4, wherein said fifth means compares said feedback component derived by said fourth means with an old feedback component derived at a timing of occurrence of an immediately preceding zero-crossing of said second sensor signal to derive a difference therebetween and disables updating of said learned value when said difference is greater than a given threshold value.

8. An air/fuel ratio control system for an internal combustion engine comprising:

an induction system for supplying an air/fuel mixture to a combustion chamber in the engine, said induction system including a fuel injection system for injecting a controlled amount of fuel for forming a desired air/fuel mixture ratio;

a first sensor monitoring a basic engine driving condition indicative parameter to produce a first sensor signal indicative thereof;

a second sensor monitoring an air/fuel ratio indicative parameter to produce a second sensor signal indicative thereof, said second sensor signal varying cyclically across zero according to a cyclic change of air/fuel mixture ratio between rich and lean across a stoichiometric value;

third means for deriving a basic fuel injection amount on the basis of said first sensor signal value;

fourth means for correcting said basic fuel injection amount with a correction value, said correction value comprises a learnt component and a feedback component to be derived on the basis of said second sensor signal value for adjusting the air/fuel ratio toward said stoichiometric value; and fifth means, responsive to said zero-crossing of said second sensor signal, for deriving an updating value to be substituted for said learnt component, said updating value being calculated as a function of said feedback component.

9. An air/fuel ratio control system for an internal combustion engine comprising:

an induction system for supplying an air/fuel mixture to a combustion chamber in the engine, said induction system including a fuel injection system for injecting a controlled amount of fuel for forming a desired air/fuel mixture ratio;

a first sensor monitoring a basic engine driving condition indicative parameter to produce a first sensor signal indicative thereof;

a second sensor monitoring an air/fuel ratio indicative parameter to produce a second sensor signal indicative thereof, said second sensor signal varying cyclically across zero according to a cyclic change of the air/fuel mixture ratio between rich and lean across a stoichiometric value;

third means for deriving a basic fuel injection amount on the basis of said first sensor signal value;

fourth means for correcting said basic fuel injection amount with a correction value, said correction value comprises a learnt component and a feedback component to be derived on the basis of said second sensor signal value for adjusting the air/fuel ratio toward said stoichiometric value; and fifth means, responsive to said zero-crossing of said second sensor signal, for deriving an updating value to be substituted for said learnt component on the basis of said feedback component.

wherein said fourth means derives said feedback component including a proportional component and an integral component.

10. An air/fuel ratio control system as set forth in claim 9, wherein said fourth means modifies said proportional component in response to zero-crossing of said second sensor signal and modifies said integral component otherwise.

11. An air/fuel ratio control system as set forth in claim 10, wherein said fifth means derives said updating value with respect to one of a plurality of preset engine driving ranges at every occurrence of updating of said learnt component.

12. An air/fuel ratio control system as set forth in claim 11, wherein said fifth means detects the engine driving condition on the basis of said first sensor signal and detects the engine driving condition satisfying a predetermined updating condition to update said learnt component with said updating value.

13. An air/fuel ratio control system as set forth in claim 12, wherein said fifth means detects the engine driving condition satisfying a predetermined feedback control condition for performing feedback controlling air fuel ratio and detects the updating condition to update said learnt data with said updating data.

14. An air/fuel ratio control system as set forth in claim 13, wherein said first sensor monitors an engine speed indicative parameter to produce an engine speed indicative signal and an engine load condition indicative parameter to produce an engine load indicative signal and said third means derives said basic fuel injection amount on the basis of said engine speed indicative signal value and said engine load indicative signal value, said fifth means derives a first average value representative of an average value of said basic fuel injection amounts derived during an interval between zero-crossing of said second sensor signal and a second average value representative of an average value of the engine speed monitored during said interval, and said fifth means derives the engine driving range about which said learnt value is to be updated, on the basis of said first and second average values.

15. An air fuel ratio control system as set forth in claim 14, wherein said fifth means further derives a maximum and minimum basic fuel injection amount during said interval and a difference therebetween and disables updating of said learned value when said difference is greater than a given threshold value.

16. An air fuel ratio control system as set forth in claim 15, wherein said fifth means further derives a maximum and minimum engine speed during said interval and a difference therebetween and disables updating of said learned value when said difference is greater than a given threshold value.

17. An air/fuel ratio control system as set forth in claim 16, wherein said fifth means compares said feedback component derived by said fourth means with an old feedback component derived at a timing of occurrence of an immediately preceding zero-crossing of said second sensor signal to derive a difference therebetween and disables updating of said learned value when said difference is greater than a given threshold value.

18. An air/fuel ratio control system for an internal combustion engine comprising:

an induction system for supplying an air/fuel mixture to a combustion chamber in the engine, said induction system including a fuel injection system for injecting a controlled amount of fuel for forming a desired air/fuel mixture ratio;

a first sensor monitoring a basic engine driving condition indicative parameter to produce a first sensor signal indicative thereof;

a second sensor monitoring air/fuel ratio indicative parameter to produce a second sensor signal indicative thereof, said second sensor signal varying cyclically across zero according to a cyclic change of air/fuel mixture ratio between rich and lean across a stoichiometric value;

third means for deriving a basic fuel injection amount on the basis of said first sensor signal value;

fourth means for correcting said basic fuel injection amount with a correction value, said correction value comprising a learnt component and a feedback component to be derived on the basis of said second sensor signal value for adjusting the air/fuel ratio toward said stoichiometric value; and fifth means for detecting a transition of the air/fuel ratio between rich and lean across a stoichiometric value on the basis of said second signal and detecting an engine driving condition satisfying a predetermined updating condition on the basis of said first sensor signal in order to derive an updating value to be substituted for said learnt component, said updating value being calculated as a function of said feedback component.

19. An air/fuel ratio control system for an internal combustion engine comprising:

an induction system for supplying an air/fuel mixture to a combustion chamber in the engine, said induction system including a fuel injection system for injecting a controlled amount of fuel for forming a desired air/fuel mixture ratio;

a first sensor monitoring a basic engine driving condition indicative parameter to produce a first sensor signal indicative thereof;

a second sensor monitoring air/fuel ratio indicative parameter to produce a second sensor signal indicative thereof, said second sensor signal varying cyclically across zero according to a cyclic change of said air/fuel mixture ratio between rich and lean across a stoichiometric value;

third means for deriving a basic fuel injection amount on the basis of said first sensor signal value;

fourth means for correcting said basic fuel injection amount with a correction value, said correction value comprising a learnt component and a feedback component to be derived on the basis of said second sensor signal value for adjusting the air/fuel ratio toward said stoichiometric value; and fifth means for detecting a transition of said air/fuel ratio between rich and lean across a stoichiometric value on the basis of said second signal and detecting an engine driving condition satisfying a predetermined updating condition on the basis of said first sensor signal in order to derive an updating value to be substituted for said learnt component on the basis of said feedback component, said fifth means deriving said updating value with respect to one of a plurality of preset engine driving ranges at every occurrence of updating of said learnt component.

20. An air/fuel ratio control system as set forth in claim 19, wherein said fifth means detects the engine driving condition on the basis of said first sensor signal and detects the engine driving condition satisfying a predetermined updating condition to update said learnt component with said updating value.

21. An air/fuel ratio control system as set forth in claim 20, wherein said fifth means detects the engine driving condition satisfying a predetermined feedback control condition for feedback controlling said air fuel mixture ratio and detects the updating condition to update said learnt data with said updating data.

22. An air/fuel ratio control system as set forth in claim 21, wherein said first sensor monitors an engine speed indicative parameter to produce an engine speed indicative signal and an engine load condition indicative parameter to produce an engine load indicative signal and said third means derives said basic fuel injection amount on the basis of said engine speed indicative signal value and said engine load indicative signal value, said fifth means derives a first average value representative of an average value of said basic fuel injection amounts derived during an interval between said transitions and a second average value representative of an average value of the engine speed monitored during said interval, and said fifth means derives the engine driving range about which said learnt value is to be updated, on the basis of said first and second average values.

23. An air fuel ratio control system as set forth in claim 22, wherein said fifth means further derives a maximum and minimum basic fuel injection amount during said interval and a difference therebetween and disables updating of said learned value when said difference is greater than a given threshold value.

24. An air fuel ratio control system as set forth in claim 22, wherein said fifth means further derives a maximum and a minimum engine speed during said interval and a difference therebetween and disables updating of said learned value when said difference is greater than a given threshold value.

25. An air/fuel ratio control system as set forth in claim 22, wherein said fifth means compares said feedback component derived by said fourth means with an old feedback component derived at a timing of occurrence of an immediately preceding transition to derive a difference therebetween and disables updating of said learned value when said difference is greater than a given threshold value.

26. An air/fuel ratio control system as set forth in claim 23, wherein said fifth means further derives a maximum and a minimum engine speed during said interval and a difference therebetween and disables updating of said learned value when said difference is greater than a given threshold value.

27. An air/fuel ratio control system as set forth in claim 23, wherein said fifth means compares said feedback component derived by said fourth means with an old feedback component derived at a timing of occurrence of an immediately preceding transition to derive a difference therebetween and disables updating of said learned value when said difference is greater than a given threshold value.

28. An air/fuel ratio control system as set forth in claim 26, wherein said fifth means compares said feedback component derived by said fourth means with an old feedback component derived at a timing of occurrence of an immediately preceding transition to derive a difference therebetween and disables updating of said learned value when said difference is greater than a given threshold value.

29. An air/fuel ratio control system as set forth in claim 28, wherein said fourth means derives said feedback component including a proportional component and an integral component.

30. An air/fuel ratio control system as set forth in claim 29, wherein said fourth means modifies said proportional component in response to said transition of said second sensor signal and modifies said integral component otherwise.

31. An air/fuel ratio control system for an internal combustion engine comprising:

an induction system for supplying an air/fuel mixture to a combustion chamber in the engine, said induction system including a fuel injection system for injecting a controlled amount of fuel for forming a desired air/fuel mixture ratio;

a first sensor monitoring a basic engine driving condition indicative parameter to produce a first sensor signal indicative thereof;

a second sensor monitoring air/fuel ratio indicative parameter to produce a second sensor signal indicative thereof, said second sensor signal varying cyclically across zero according to a cyclic change of said air/fuel mixture ratio between rich and lean across a stoichiometric value;

third means for deriving a basic fuel injection amount on the basis of said first sensor signal value;

fourth means for correcting said basic fuel injection amount with a correction value, said correction value comprising a learnt component and a feedback component to be derived on the basis of said second sensor signal value for adjusting the air/fuel ratio toward said stoichiometric value; and fifth means for detecting a transition of said air/fuel ratio between rich and lean across a stoichiometric value on the basis of said second signal and detecting an engine driving condition satisfying a predetermined updating condition on the basis of said first sensor signal in order to derive an updating value to be substituted for said learnt component on the basis of said feedback component, wherein said fourth means modifies said feedback component including a proportional component and an integral component.

32. An air/fuel ratio control system as set forth in claim 31, wherein said fourth means modifies said proportional component in response to said transition and modifies said integral component otherwise.

33. An air/fuel ratio control system as set forth in claim 32, wherein said fifth means derives said updating value with respect to one of a plurality of preset engine driving range at every occurrence of updating of said learnt component.

34. An air/fuel ratio control system as set forth in claim 33, wherein said fifth means detects the engine driving condition on the basis of said first sensor signal and detect the engine driving condition satisfying a predetermined updating condition to update said learnt component with said updating value.

35. An air/fuel ratio control system as set forth in claim 34, wherein said fifth means detects the engine driving condition satisfying a predetermined feedback control condition for performing feedback controlling air fuel ratio and detects the updating condition to update said learnt data with said updating data.

36. An air/fuel ratio control system as set forth in claim 35, wherein said first sensor monitors an engine speed indicative parameter to produce an engine speed indicative signal and an engine load condition indicative parameter to produce an engine load indicative signal and said third means derives said basic fuel injection amount on the basis of said engine speed indicative signal value and said engine load indicative signal value, said fifth means derives a first average value representative of an average value of said basic fuel injection amounts derived during an interval between said transition and a second average value representative of an average value of the engine speed monitored during said interval, and said fifth means derives the engine driving range about which said learnt value is to be updated, on the basis of said first and second average values.

37. An air/fuel ratio control system as set forth in claim 36, wherein said fifth means further derives a maximum and a minimum basic fuel injection amount during said interval and a difference therebetween and disables updating of said learned value when said difference is greater than a given threshold value.

38. An air/fuel ratio control system as set forth in claim 37, wherein said fifth means further derives a maximum and a minimum engine speed during said interval and a difference therebetween and disables updating of said learned value when said difference is greater than a given threshold value.

39. An air/fuel ratio control system as set forth in claim 38, wherein said fifth means compares said feedback component derived by said fourth means with an old feedback component derived at a timing of occurrence of an immediately preceding transition to derive a difference therebetween and disables updating of said learned value when said difference is greater than a given threshold value.

* * * * *